US012262857B2

(12) United States Patent
Qiao et al.

(10) Patent No.: US 12,262,857 B2
(45) Date of Patent: Apr. 1, 2025

(54) CLEANING DEVICE AND SWEEPING ASSEMBLY THEREOF

(71) Applicants: BEIJING XIAOMI MOBILE SOFTWARE CO., LTD., Beijing (CN); Beijing Rockrobo Technology Co., Ltd., Beijing (CN)

(72) Inventors: Liang Qiao, Beijing (CN); Xing Li, Beijing (CN); Yongfeng Xia, Beijing (CN)

(73) Assignees: BEIJING XIAOMI MOBILE SOFTWARE CO., LTD., Beijing (CN); Beijing Rockrobo Technology Co., Ltd., Beijing (CN)

( * ) Notice: Subject to any disclaimer, the term of this patent is extended or adjusted under 35 U.S.C. 154(b) by 0 days.

(21) Appl. No.: 18/391,552

(22) Filed: Dec. 20, 2023

(65) Prior Publication Data

US 2024/0122433 A1 Apr. 18, 2024

Related U.S. Application Data

(63) Continuation of application No. 16/931,221, filed on Jul. 16, 2020, now Pat. No. 11,882,970, which is a (Continued)

(30) Foreign Application Priority Data

Apr. 14, 2016 (CN) ..... 201610232744.5

(51) Int. Cl.
*A47L 11/40* (2006.01)
*A47L 5/22* (2006.01)
(Continued)

(52) U.S. Cl.
CPC ..... *A47L 11/4041* (2013.01); *A47L 5/22* (2013.01); *A47L 9/0455* (2013.01); *A47L 9/0477* (2013.01); *A47L 9/0488* (2013.01); *A47L 9/2847* (2013.01); *A47L 9/2852* (2013.01); *A47L 9/2857* (2013.01); *A47L 9/2884* (2013.01); *A47L 11/24* (2013.01); *A47L 11/282* (2013.01); *A47L 11/4005* (2013.01); *A47L 11/4008* (2013.01); *A47L 11/4011* (2013.01); *A47L 11/4061* (2013.01); *A47L 2201/00* (2013.01)

(58) Field of Classification Search
CPC ... A47L 11/4041; A47L 9/0466; A47L 9/0477
See application file for complete search history.

(56) References Cited

U.S. PATENT DOCUMENTS 4,912,805 A * 4/1990 Krasznai ..... A47L 9/0477 15/207.2

* cited by examiner

*Primary Examiner* — Shay Karls
(74) *Attorney, Agent, or Firm* — Arch & Lake LLP

(57) ABSTRACT

A sweeping assembly for a cleaning device, includes: a brush holder defining an accommodating cavity therein; a main brushroll accommodated in the accommodating cavity of the brush holder, the main brushroll including a cleaning part located at a middle portion of the main brushroll and a connecting part located at an end of the main brushroll, the connecting part being connected to the brush holder or a driver of the cleaning device; and an anti-winding structure arranged at the brush holder, and including a first end connected to the brush holder, and a second end abutting against the brushroll.

15 Claims, 9 Drawing Sheets

Related U.S. Application Data continuation of application No. 15/484,681, filed on Apr. 11, 2017, now Pat. No. 10,750,921.

(51) Int. Cl.

| | |
|---|---|
| ***A47L 9/04*** | (2006.01) |
| ***A47L 9/28*** | (2006.01) |
| ***A47L 11/24*** | (2006.01) |
| ***A47L 11/282*** | (2006.01) |

CLEANING DEVICE AND SWEEPING ASSEMBLY THEREOF

CROSS-REFERENCE TO RELATED APPLICATIONS

This application is a Continuation Application of U.S. application Ser. No. 16/931,221, which is based on and claims priority to Chinese Patent Application No. 201610232744.5, filed on Apr. 14, 2016, the entire contents of which are incorporated herein by reference for all purposes.

TECHNICAL FIELD

The present disclosure relates to a technical field of smart home, and more particularly, to a cleaning device and a sweeping assembly thereof.

BACKGROUND

With the development of technology, a variety of automatic cleaning devices have emerged, such as automatic sweeping robots, automatic mopping robots, and so on. The automatic cleaning device may perform cleaning operations automatically, which brings convenience to users. For example, the automatic sweeping robot achieves automatic cleaning of places through direct brushing, vacuum cleaning, and other technologies.

SUMMARY

The present disclosure provides a cleaning device and a sweeping assembly thereof, to solve the defects in the related art.

According to a first aspect of the present disclosure, a sweeping assembly for a cleaning device is provided, and includes: a brush holder defining an accommodating cavity therein; a main brushroll accommodated in the accommodating cavity of the brush holder, the main brushroll including a cleaning part located at a middle portion of the main brushroll and a connecting part located at an end of the main brushroll, the connecting part being connected to the brush holder or a driver of the cleaning device; and an anti-winding structure arranged at the brush holder, and including a first end connected to the brush holder, and a second end abutting against the brushroll.

According to a second aspect of the present disclosure, a cleaning device is provided, and includes: a sweeping assembly; and a driver connected to the sweeping assembly and configured to drive the sweeping assembly to rotate. The sweeping assembly includes: a brush holder; a brush body arranged in the brush holder, and including a cleaning part and a connecting part connected to each other, the connecting part being further connected to the driver to rotate the brush body, the cleaning part including a brush member protruding outward therefrom; and an anti-winding structure arranged at the brush holder and including a first end connected to the brush holder, and a second end abutting against the brushroll, the anti-winding structure configured to fill up a gap between the brush holder and the connecting part by the transfer of the second end.

It is to be understood that both the foregoing general description and the following detailed description are exemplary and explanatory only and are not restrictive of the disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to embodiments, examples of which are illustrated in the accompanying drawings. The following description refers to the accompanying drawings in which the same numbers in different drawings represent the same or similar elements unless otherwise represented. The implementations set forth in the following description of embodiments do not represent all implementations consistent with the invention. Instead, they are merely examples of apparatuses and methods consistent with aspects related to the invention as recited in the appended claims.

Figure 1:
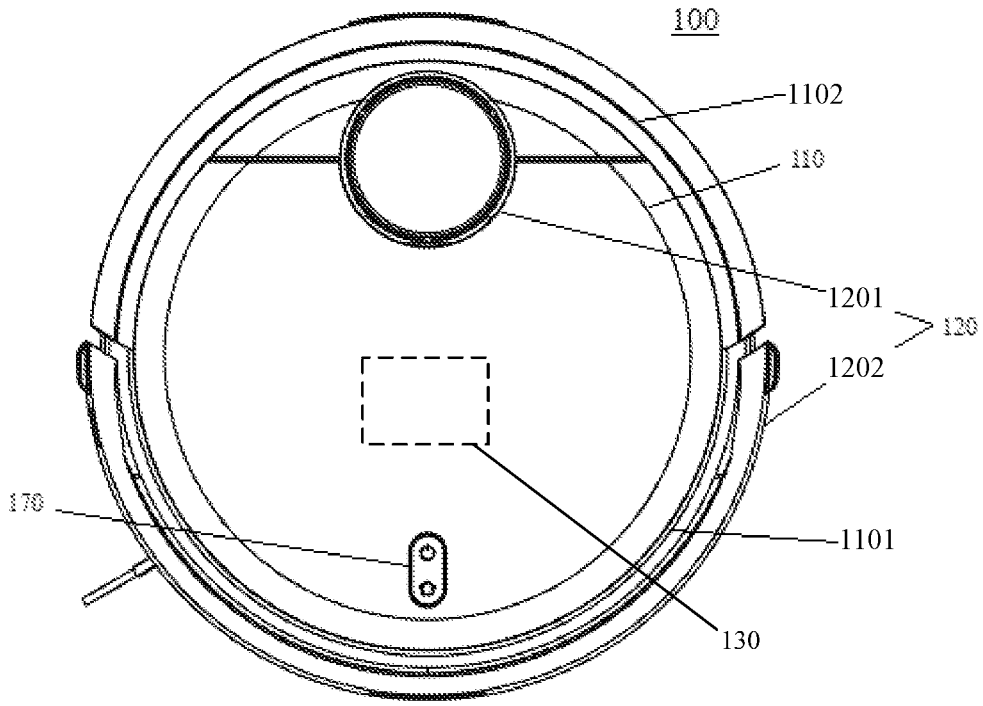
FIG. 1 is a top schematic view of a robot according to one or more embodiments.

FIGS. 1-4 are schematic views of a robot according to one or more embodiments. FIG. 1 is a top schematic view of a robot according to one or more embodiments. As shown in FIG. 1, the robot 100 may be an automatic cleaning device, such as a sweeping robot or a mopping robot. The robot 100 may include a robot body 110, a sensing system 120, a control system 130, and a human-robot interaction system 170.

The robot body 110 includes a forward portion 1101 and a rearward portion 1102, and has an approximately round shape (both front and rear ends being round). The robot body 110 may have other shapes, for example including but not limited to an approximate D shape which has a square front end and a round rear end.

The sensing system 120 includes a position determining device 1201 located above the robot body 110, a bumper sensor 1202 located at the forward portion 1101 of the robot body 110, a cliff sensor 1203, an ultrasonic sensor (not shown), an infrared sensor (not shown), a magnetometer (not shown), an accelerometer (not shown), a gyroscope (not shown), an odometer (not shown) and other sensing devices, so as to provide the control system 130 with various position information and motion state information of the robot. The position determining device 1201 includes a camera and a laser distance sensor (LDS), but is not limited thereto.

The forward portion 1101 of the robot body 110 may carry the bumper sensor 1202. When a drive wheel module 141 pushes the robot to walk on the ground in a cleaning process, the bumper sensor 1202 detects one or more events (or objects) in a travel path of the robot 100, via the sensing system, for example the infrared sensor. The robot may control the drive wheel module 141 so as to respond to the events (or objects), for example, keeping away from obstacles, based on the events (or objects) detected by the bumper sensor 1202, such as the obstacles, walls, etc.

The control system 130 is provided on a circuit mainboard inside the robot body 110, and includes a computing processor communicated with a non-transitory memory (e.g. a hard disk, a flash memory or a RAM), such as a central processing unit and an application processor, in which the application processor utilizes a positioning algorithm, for example SLAM, to draw a real-time map of the environment where the robot is, based on the obstacle information fed back by the LDS. Moreover, the control system 130 comprehensively determines a current working state of the sweeping robot in combination with distance information and speed information fed back by the bumper sensor 1202, the cliff sensor 1203, the ultrasonic sensor, the infrared sensor, the magnetometer, the accelerometer, the gyroscope, the odometer and the like. For instance, the sweeping robot is going across a doorsill, going onto a carpet, or located at the cliff; or an upper portion or a lower portion of the sweeping robot is stuck; or a dust box thereof is full; or the sweeping robot is lifted. The control system 130 may further give the next specific action strategy in the light of above different situations, to make the working of the robot more in line with the requirements of the owner and thus ensure a better user experience. Further, the control system 130 may plan the most efficient and reasonable sweeping path and sweeping mode based on information of the real-time map drawn through SLAM, thus improving a sweeping efficiency of the robot greatly.

The human-robot interaction system 170 includes keys provided on a panel of the main machine and configured for function selection by the user. The human-device interaction system 170 may further include a display screen and/or an indicator light and/or a speaker that are configured to show the user the current state of the robot or function options. Moreover, the human-device interaction system 170 may further include a mobile client program. For a cleaning device of a path-navigation type, a mobile client may show the user a map of an environment where the device is located, and a location of the robot, so as to provide the user with richer and user-friendlier function options.

Figure 2:
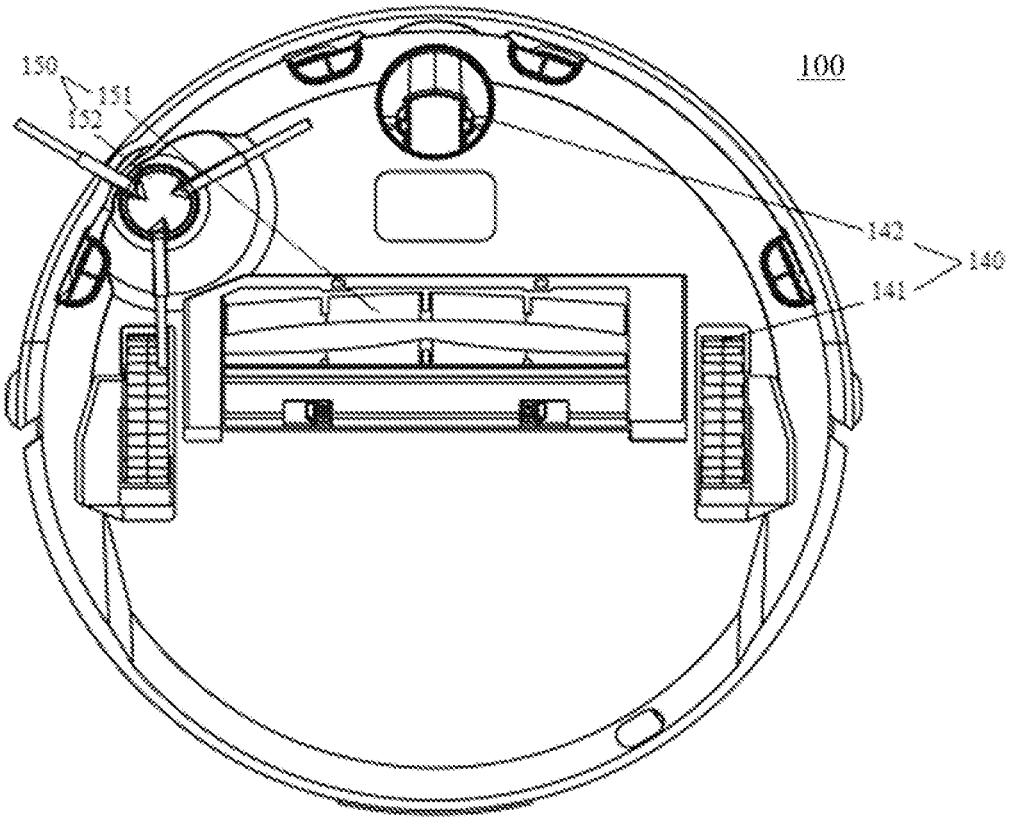
FIG. 2 is a bottom schematic view of a robot according to one or more embodiments.

FIG. 2 is a bottom schematic view of a robot according to one or more embodiments. As shown in FIG. 2, the robot 100 may further include a drive system 140 and a cleaning system 150. The drive system 140 and the cleaning system 150 may be disposed on the bottom surface of the robot 100. The drive system 140 may manipulate the robot 100 to travel across the ground based on a drive instruction having distance and angle information, for example x, y and 0 components. The drive system 100 includes the drive wheel module 141, and the drive wheel module 141 may control a left wheel and a right wheel simultaneously. The drive wheel module 141 preferably includes a left drive wheel module and a right drive wheel module for more precise control over the motion of the robot. The left drive wheel module and the right drive wheel module are arranged opposite to each other along a transverse axis defined by the robot body 110.

To enable the robot to move on the ground more stably or have a stronger moving ability, the robot may include one or more driven wheels 142 which include but are not limited to universal wheels. The drive wheel module includes a travel wheel, a drive motor, and a control circuit for controlling the drive motor, and may be connected with a circuit for measuring a drive current and an odometer. The drive wheel module 141 may be detachably connected to the robot body 110, thus facilitating assembling, disassembling, and maintenance thereof. The drive wheel module may have an offset drop-type suspension system, be fastened in a movable manner, for example, attached to the robot body 110 in a rotatable manner, and receive a spring offset biased downwards and away from the robot body 110. The spring offset allows the drive wheel to maintain contact and traction with the ground by a certain ground adhesive force, and meanwhile, a cleaning element of the robot 100 also touches the ground with a certain pressure.

The cleaning system 150 may be configured as a dry cleaning system and/or a wet cleaning system. As the dry cleaning system, the main cleaning function comes from a sweeping system 151 including a brushroll structure, a dust box structure, a fan structure, an air outlet, and connecting members among the four parts. The brushroll structure that has certain interference with the ground sweeps up rubbish on the ground and carries it to a dust suction port between the brushroll structure and the dust box structure, and then the rubbish is sucked into the dust box structure by a suction gas generated by the fan structure and passing through the dust box structure. A dedusting capability of the sweeping robot may be represented by a dust pick up (DPU) efficiency, and the DPU efficiency is influenced by a structure and materials of a brushroll, by a wind power utilization rate of air channels constituted by the dust suction port, the dust box structure, the fan structure, the air outlet and the connecting members among the four parts, and by a type and a power of a fan, and thus the DPU efficiency is a complex system design issue. Compared with an ordinary plug-in cleaner, enhancement of the dedusting capability is more significant for a cleaning robot with limited energy. Because the enhancement of the dedusting capability lowers an energy requirement effectively, i.e., the robot, which originally sweeps 80 square meters of ground on one charge, may sweep 100 square meters of ground or even more on one charge now. Moreover, a service life of a battery will be extended greatly due to the reduced number of charge cycles, such that the frequency of replacing the battery by a user will be decreased. More intuitively and importantly, the enhancement of the dedusting capability brings the most prominent and significant user experience, and the user may directly draw a conclusion whether the robot sweeps or wipes cleanly. The dry cleaning system may further include a side brush 152 having a rotating shaft, and the rotating shaft has a certain angle relative to the ground, so as to move debris into a brushroll region of the cleaning system 150.

Figure 3:
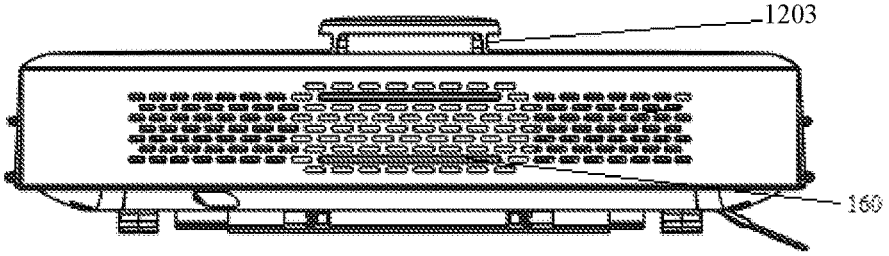
FIG. 3 is a side schematic view of a robot according to one or more embodiments.

FIG. 3 is a side schematic view of a robot according to one or more embodiments. The robot 100 may further include an energy system 160. For example, the energy system 160 may include a rechargeable battery, such as a Ni-MH battery and a lithium battery. The rechargeable battery may be connected with a charge control circuit, a circuit for detecting a charging temperature of a battery pack, and a circuit for monitoring battery under-voltage, and then these three circuits are connected to a single-chip control circuit. A main machine is charged by connecting a charging electrode with a charging post, in which the charging electrode is provided at a side of the main machine or below the main machine. If the exposed charging electrode is adhered with dust, an accumulative effect of charge will cause melting and deformation of a plastic body around the electrode in a charging process, and even lead to deformation of the electrode per se, thus failing to continue normal charging.

Figure 4:
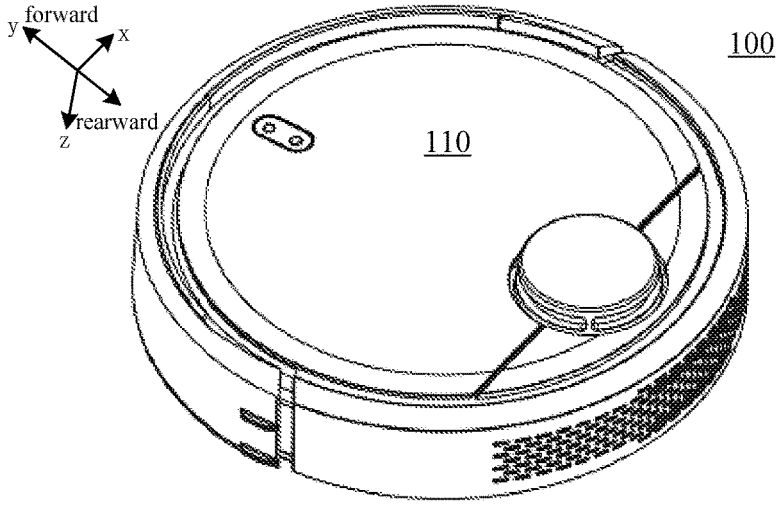
FIG. 4 is a schematic view of a robot according to one or more embodiments.

FIG. 4 is a schematic view of a robot according to one or more embodiments. In order to describe behaviors of the robot more clearly, directions are defined as follows. The robot 100 may travel on the ground through various combinations of movements relative to three mutually perpendicular axes, namely, a transverse axis x, a front-rear axis y and a central vertical axis z, which are defined by the robot body 110. A forward driving direction along the front-rear axis y is denoted as "forward", and a rearward driving direction along the front-rear axis y is denoted as "rearward." The transverse axis x substantially extends between the right wheel and the left wheel of the robot along an axis center defined by a central point of the drive wheel module 141, in which the robot 100 may rotate around the axis x. When the forward portion of the robot 100 inclines upwards and the rear portion thereof inclines downwards, the robot "pitches up"; when the forward portion of the robot 100 inclines downwards and the rear portion thereof inclines upwards, the robot "pitches down." Moreover, the robot 100 may rotate around the axis z. In a forward direction of the robot, when the robot 100 inclines towards a right side of the axis y, the robot "turns right"; when the robot 100 inclines towards a left side of the axis y, the robot "turns left."

When the cleaning system 150 implements a cleaning operation, objects to be cleaned may be divided into two types, i.e. heavy particles and light debris. The light debris includes human and animal hair, strings, threads, carpet fibers and etc., which are easily stretched to wrap around a brush body of the cleaning system 150, and the accumulation of the light debris may degrade performance of the brush body in various ways. For example, the light debris may cover and tightly wrap around bristles of the brush body and be tangled with the bristles, thus resulting in extra friction and hence hindering rotation of the brush body. Furthermore, if the light debris are not removed in time, the light debris may accumulate up to a joint of the brush body and a brush holder on which the brush body is arranged, and then be carried into a gear box and other regions, thus damaging the gear box or causing other unexpected situations. Additionally, the light debris accumulated on the brush body may result in internal imbalance of the brush body and produce noise or vibration during the rotation of the brush body.

Therefore, the present disclosure aims to solve the above technical problems existing in the related art through structural improvement on a sweeping assembly (equivalent to the cleaning system 150) of the automatic cleaning device.

In technical solutions of the present disclosure, the sweeping assembly of the automatic cleaning device may include: a brush body and a brush holder configured to accommodate the brush body; an anti-winding structure located at a joint of the brush body and the brush holder and configured to at least partially fill a gap at the joint when the sweeping assembly is in a working state. In one or more embodiments, the anti-winding structure is configured to fill up the gap at the joint when the sweeping assembly is in the working state. In this embodiment, by providing the anti-winding structure at the joint of the brush body and the brush holder, the gap between the brush body and the brush holder may be blocked to prevent elongated objects, especially hair, from entering a drive part (i.e. a gear box) of the brush body through the gap and affecting the rotation of the brush body, thus reducing a damage rate of the drive part and improving reliability of the automatic cleaning device.

Actually, the brush body of the automatic cleaning device may have various types, and a fitting relationship among the brush body, the brush holder and the anti-winding structure for each type will be described in detail.

1. Main Brushroll Structure

Figure 5:
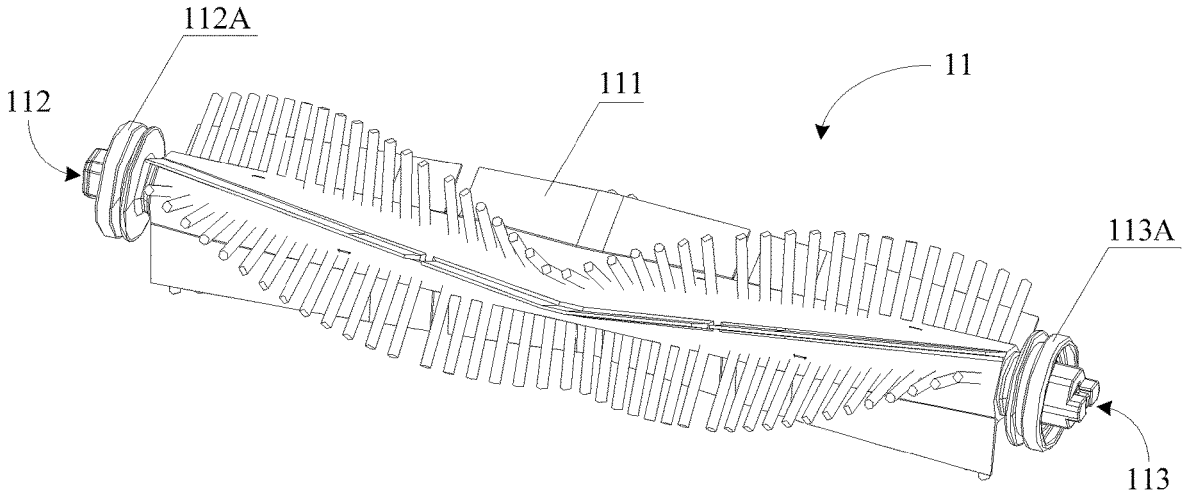
FIG. 5 is a perspective schematic view of a main brushroll according to one or more embodiments.

In one or more embodiments, as shown in FIG. 5, the brush body may be configured as a main brushroll 11, and the main brushroll 11 includes a cleaning part 111 located in middle of the main brushroll 11, a rotating-shaft connecting part 112 located at one end of the main brushroll 11, and a driven connecting part 113 located at the other end of the main brushroll 11.

The cleaning part 111 is configured to perform a sweeping function of the main brushroll 11 and includes a cylindrical rotating portion (not shown in drawings) and a rubber brush member or a hairbrush member (not shown in drawings; actually, the rubber brush member and the hairbrush member both are included simultaneously in the embodiment illustrated in FIG. 5) provided on a side surface of the cylindrical rotating portion.

The rotating-shaft connecting part 112 is fitted with a drive motor (not shown in drawings) to drive the cleaning part 111 to rotate axially, thus performing the cleaning operation. Meanwhile, the rotating-shaft connecting part 112 and the driven connecting part 113 further need to be mounted to and fitted with other parts of the automatic cleaning device, and thus a first circumferential protrusion 112A is formed at the rotating-shaft connecting part 112 and a second circumferential protrusion 113A is formed at the driven connecting part 113, such that the cleaning part 111 can be provided with external conditions for performing the cleaning operation.

It should be noted that, in some automatic cleaning devices, the first circumferential protrusion 112A, the second circumferential protrusion 113A, and the cylindrical rotating portion of the cleaning part 111 may be configured as an integral structure, which may not be dissembled without breaking the integral structure. In other automatic cleaning devices, the first circumferential protrusion 112A and the second circumferential protrusion 113A may be configured as separate detachable structures, and since the first circumferential protrusion 112A and the second circumferential protrusion 113A are located at the two ends of the main brushroll 11, they are called "end covers."

Figure 6:
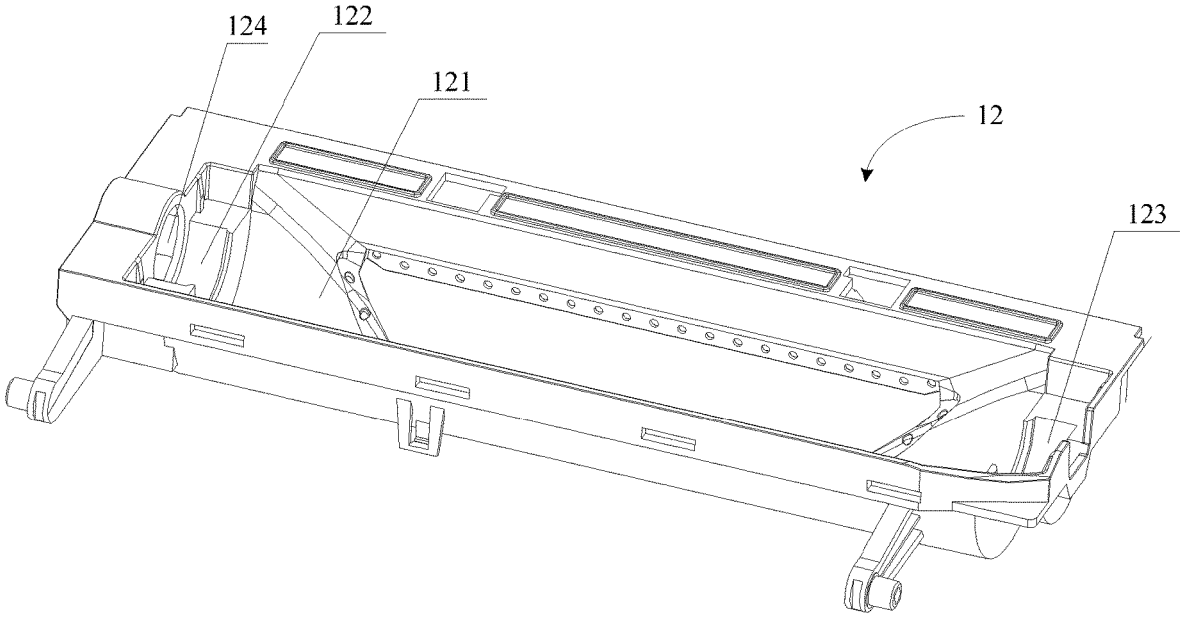
FIG. 6 is a perspective schematic view of a brushroll chamber according to one or more embodiments.
Figure 7:
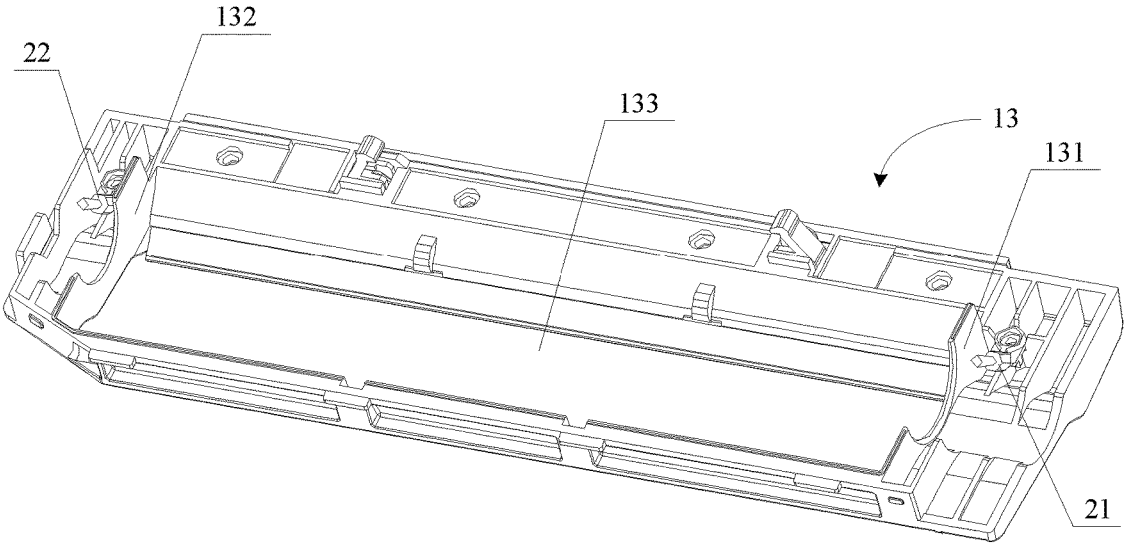
FIG. 7 is a perspective schematic view of a brushroll casing according to one or more embodiments.

Fitted with the main brushroll 11 described above, the brushroll holder in this embodiment may include a brushroll chamber 12 shown in FIG. 6 and a brushroll casing 13 shown in FIG. 7, such that the main brushroll 11 can be accommodated in a space defined by the brushroll chamber 12 and the brushroll casing 13.

As shown in FIG. 6, a central region of the brushroll chamber 12 serves as a first recessed region 121 corresponding to the cleaning part 111 of the main brushroll 11 and is configured to accommodate the cleaning part 111. A second recessed region 122 and a third recessed region 123 are formed at two sides of the first recessed region 121 respectively and configured to accommodate the first circumferential protrusion 112A at the rotating-shaft connecting part 112 of the main brushroll 11 and the second circumferential protrusion 113A at the driven connecting part 113 of the main brushroll 11, respectively. Moreover, as shown in FIGS. 5-6, a recession depth of the first recessed region 121 is larger than that of the second recessed region 122 and that of the third recessed region 123, so as to match with size differences among the cleaning part 111, the rotating-shaft connecting part 112, and the driven connecting part 113.

Because the second recessed region 122 corresponds to the rotating-shaft connecting part 112, an opening 124 is formed in an end face of the brushroll chamber 12, in which the end face is located at a side of the brushroll chamber 12 corresponding to the second recessed region 122, such that the rotating shaft at the rotating-shaft connecting part 112 may be connected to a power output end of the drive motor through the opening 124.

As shown in FIG. 7, two ends of the brushroll casing 13 are provided with a first brushroll-casing baffle 131 and a second brushroll-casing baffle 132, respectively. An arc notch is formed in each of the first brushroll-casing baffle 131 and the second brushroll-casing baffle 132, respectively. A space 133 is formed between the first brushroll-casing baffle 131 and the second brushroll-casing baffle 132, such that when the main brushroll 11 is mounted between the brushroll chamber 12 and the brushroll casing 13, the cleaning part 111 may be located in an accommodating space formed by the first recessed region 121 and the space 133, the first brushroll-casing baffle 131 and the second brushroll-casing baffle 132 support the cleaning part 111 at two ends thereof respectively, and the rotating-shaft connecting part 112 is located at an outer side (i.e. a right side in FIG. 7) of the first brushroll-casing baffle 131 while the driven connecting part 113 is located at an outer side (i.e. a left side in FIG. 7) of the second brushroll-casing baffle 132. Because a bottom of the brushroll casing 13 has a hollow-out structure, the cleaning part 111 may be in contact with a plane to be cleaned, such as the ground, thereby achieving the sweeping function.

Figure 8A:
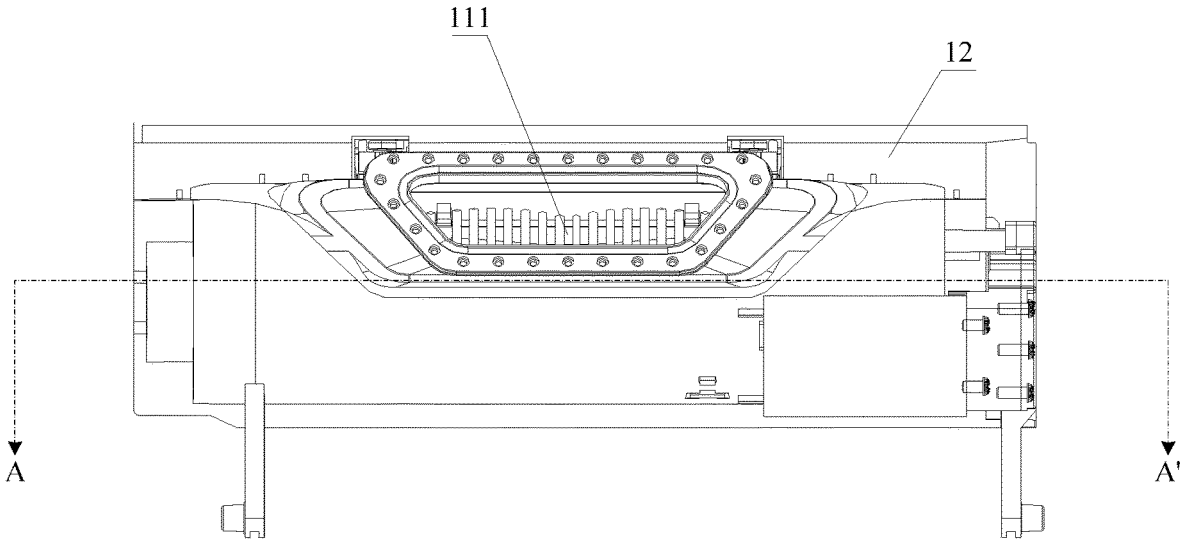
FIG. 8A is a schematic view of a main brushroll structure from a top view according to one or more embodiments.
Figure 8B:
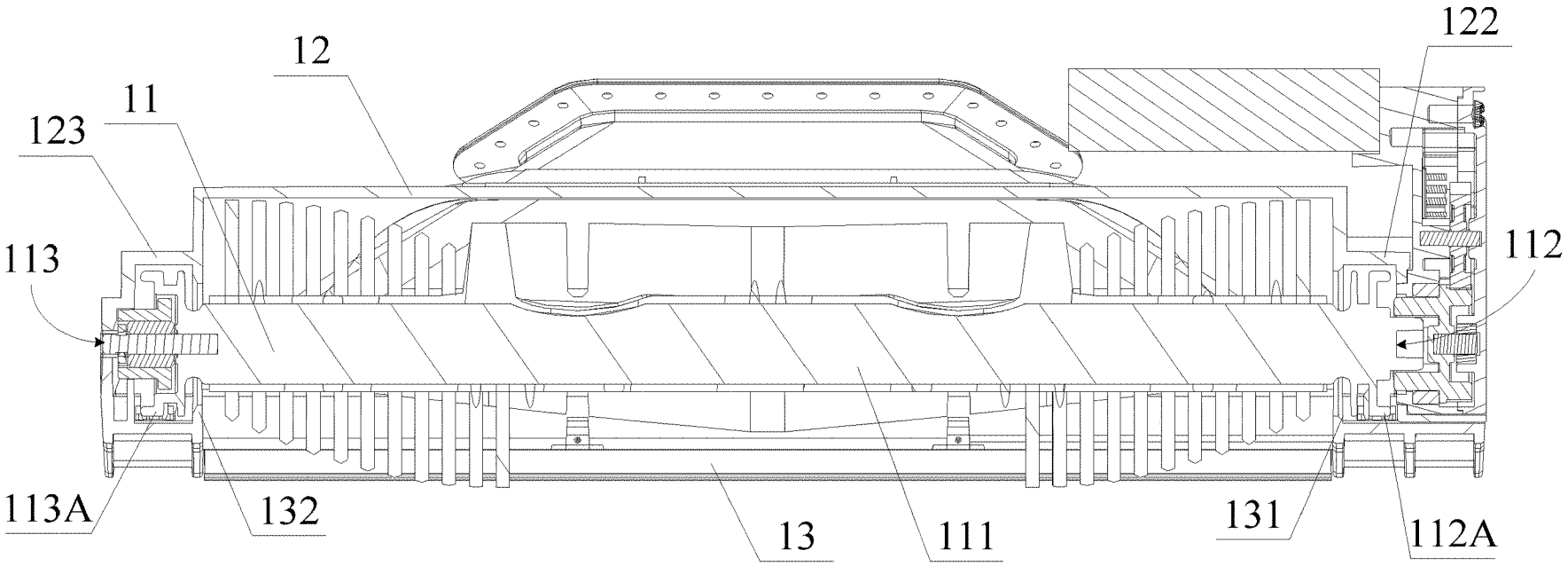
FIG. 8B is a sectional view of the main brushroll shown in FIG. 8A along an A-A' direction.

For ease of understanding, FIG. 8A is a top view in which the main brushroll 11 is mounted within the brushroll chamber 12 and the brushroll casing 13 (the brushroll casing 13 cannot be observed in FIG. 8A due to the observing angle), and FIG. 8B is a sectional view of what is shown in FIG. 8A along an A-A' direction.

In one or more embodiments, when the joint of the brush body and the brush holder, i.e. a joint of the main brushroll 11 and the brushroll chamber 12 and a joint of the main brushroll 11 and the brushroll casing 13, is described based on corresponding regions of the main brushroll 11, the joint may be located at one or more of following regions: a first joint region between the cleaning part 111 and the rotating-shaft connecting part 112, and a second joint region between the cleaning part 111 and the driven connecting part 113.

Figure 9:
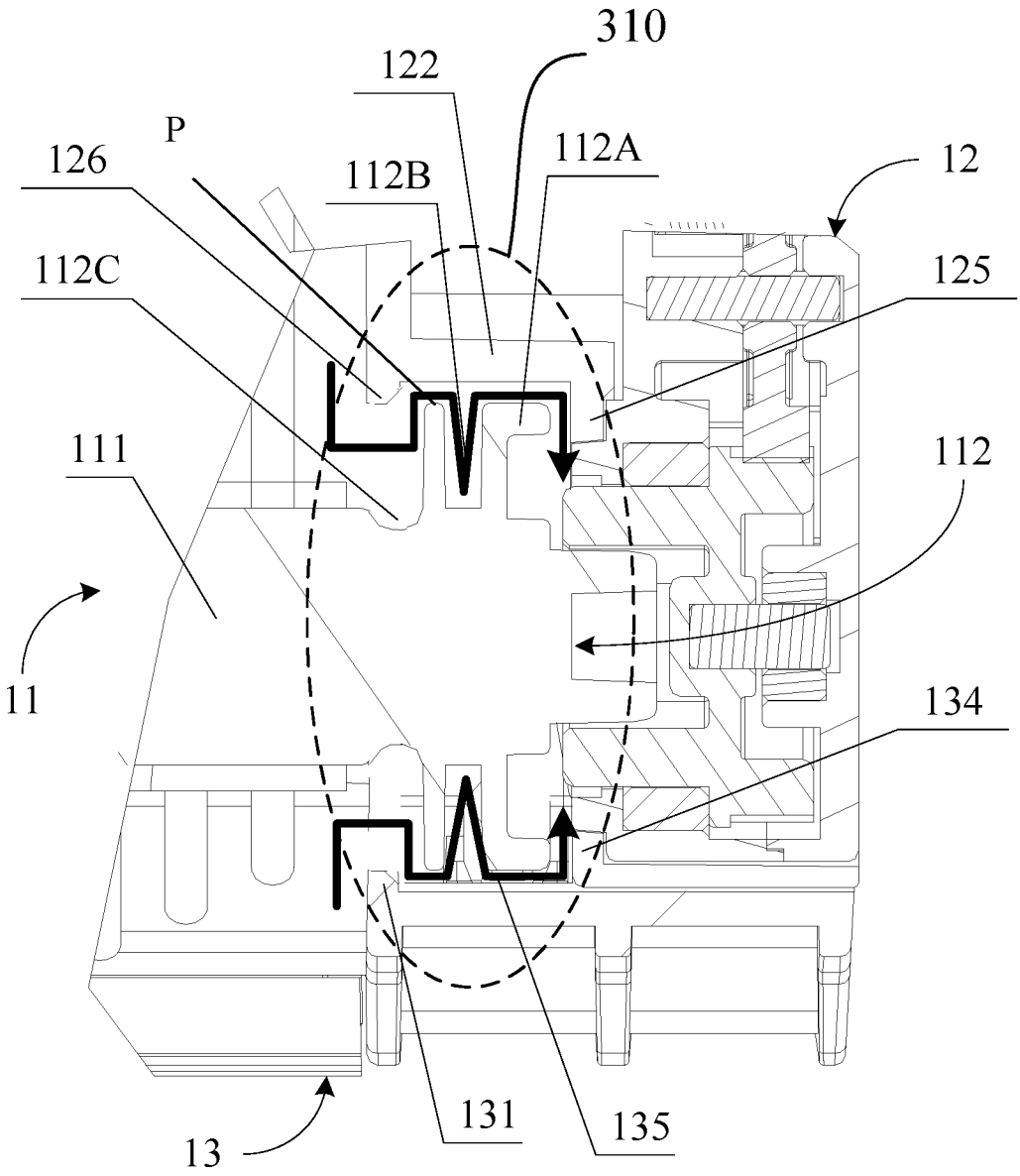
FIG. 9 is a partially enlarged view of a first joint region of the main brushroll structure shown in FIG. 8A.

FIG. 9 is a partially enlarged view of the first joint region 310. As shown in FIG. 9, when the first joint region 310 is located between the cleaning part 111 and the rotating-shaft connecting part 112, the joint in the first joint region 310 may be located at the first circumferential protrusion 112A, i.e. the anti-winding structure may be located at the first circumferential protrusion 112A. For example, as shown in FIG. 7, one end of a first anti-winding structure 21 may be fixed to an inner side (a side facing the main brushroll 11, i.e. an upper side in FIG. 7) of the brushroll casing 13, and the other end thereof faces the first circumferential protrusion 112A. Hence, when the automatic cleaning device is in the working state, i.e. the main brushroll 11 rotates at a high speed axially, the first circumferential protrusion 112A may be driven to rotate synchronously along therewith, and the other end of the first anti-winding structure 21 may touch and abut against a surface of the first circumferential protrusion 112A. Thus, on one hand, the first anti-winding structure 21 fills up the gaps at the joints between the main brushroll 11 and the brushroll chamber 12 and between the main brushroll 11 and the brushroll casing 13 (i.e. the gap between the first circumferential protrusion 112A and a top inner wall of the second recessed region 122 and the gap between the first circumferential protrusion 112A and a bottom inner wall of a region outside of the first brushroll-casing baffle 131, which gaps are indispensable and inevitable for smooth rotation of the main brushroll 11) to prevent the objects to be cleaned from roaming from the cleaning part 111 to the rotating-shaft connecting part 112 and prevent them from entering the gear box region at the end of the rotating-shaft connecting part 112, i.e. the first anti-winding structure 21 acts as a barrier between the cleaning part 111 and the gear box region; on the other hand, the first anti-winding structure 21 may sweep the surface of the first circumferential protrusion 112A which is rotating, thereby sweeping up and collecting the objects to be cleaned which roam hereto, so as to facilitate intensive clean-up of the objects to be cleaned.

Figure 10:
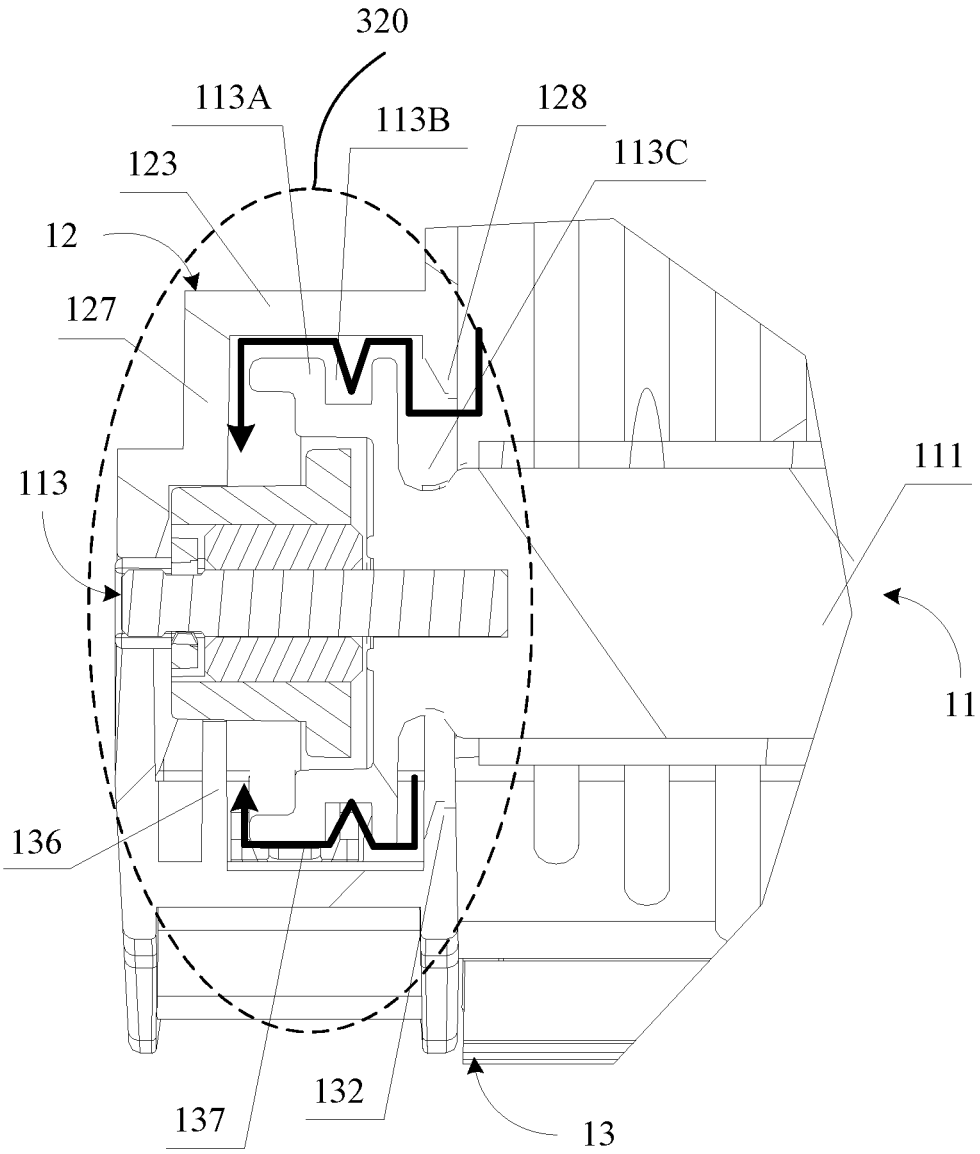
FIG. 10 is a partially enlarged view of a second joint region of the main brushroll structure shown in FIG. 8A.

Similarly, FIG. 10 is a partially enlarged view of the second joint region 320. As shown in FIG. 10, when the second joint region 320 is located between the cleaning part 111 and the driven connecting part 113, the joint in the second joint region 320 may be located at the second circumferential protrusion 113A, i.e. the anti-winding structure may be located at the second circumferential protrusion 113A. For example, as shown in FIG. 7, one end of a second anti-winding structure 22 may be fixed to the inner side (the side facing the main brushroll 11, i.e. the upper side in FIG. 7) of the brushroll casing 13, and the other end thereof faces the second circumferential protrusion 113A. Hence, when the automatic cleaning device is in the working state, i.e. the main brushroll 11 rotates at a high speed axially, the second circumferential protrusion 113A may be driven to rotate synchronously along therewith, and the other end of the second anti-winding structure 22 may touch and abut against a surface of the second circumferential protrusion 113A. Thus, on one hand, the second anti-winding structure 22 fills up the gaps at the joints between the main brushroll 11 and the brushroll chamber 12 and between the main brushroll 11 and the brushroll casing 13 (i.e. the gap between the second circumferential protrusion 113A and a top inner wall of the third recessed region 123 and the gap between the second circumferential protrusion 113A and a bottom inner wall of a region outside of the second brushroll-casing baffle 132) to prevent the objects to be cleaned from roaming from the cleaning part 111 to the driven connecting part 113 and prevent them from winding around an end portion of the driven connecting part 113, i.e. the second anti-winding structure 22 acts as a barrier between the cleaning part 111 and the end portion of the driven connecting part 113; on the other hand, the second anti-winding structure 22 may sweep the surface of the second circumferential protrusion 113A which is rotating, thereby sweeping up and collecting the objects to be cleaned which roam hereto, so as to facilitate intensive clean-up of the objects to be cleaned.

In this disclosure, the anti-winding structure may include one or more bristles. While the roller brush moves during a working state, debris including hair and wool may be inevitably wrapped in the roller brush shaft and move toward the first and second joint regions. When there is no anti-winding structure, the debris may fill the gap quickly, resulting in rolling roller rotation difficulty or even stopping the rolling roller completely. The anti-winding structure prevents the debris from moving into the gap. Alternatively or additionally, the anti-winding structure may automatically clean up the debris from the gaps.

1) In the embodiment shown in FIG. 7, the first anti-winding structure 21 (the same applies to the second anti-winding structure 22, and the first anti-winding structure 21 is just taken as an example) may be made of soft materials, for example, a tuft (or tufts) of bristles (or other materials like sponge blocks), such that when the first anti-winding structure 21 abuts against the first circumferential protrusion 112A, a degree of close fit therebetween is enhanced through partial deformation of the first anti-winding structure 21, thus improving effects of blocking and sweeping the objects to be cleaned. A direction of the bristles may have a certain included angle relative to a radial direction of the brushroll, or be identical to the radial direction of the brushroll. Materials of the bristle may be nylon or polybutylene terephthalate (called PBT for short).
2) Alternatively or additionally, the first circumferential protrusion 112A may be provided with at least one first anti-winding groove 112B disposed circumferentially. For example, as shown in FIG. 9, the first anti-winding groove 112B may be located at a side of the first circumferential protrusion 112A adjacent to the cleaning part 111, i.e. the first anti-winding groove 112B is located between the first anti-winding structure 21 and the cleaning part 111, such that the objects to be cleaned which are blocked and concentrated by the first anti-winding structure 21 may be received in the first anti-winding groove 112B. Similarly, the second circumferential protrusion 113A may be provided with at least one first anti-winding groove 113B disposed circumferentially. For example, as shown in FIG. 10, the first anti-winding groove 113B may be located at a side of the second circumferential protrusion 113A adjacent to the cleaning part 111, i.e. the first anti-winding groove 113B is located between the second anti-winding structure 22 and the cleaning part 111, so as to receive the objects to be cleaned, which will not be described herein.
3) Alternatively or additionally, at least one second anti-winding groove 112C disposed circumferentially may be formed at a junction of the cleaning part 111 and the first circumferential protrusion 112A. For example, as shown in FIG. 9, the second anti-winding groove 112C may be adjacent to a left side of the first circumferential protrusion 112A, such that the objects to be cleaned are first collected and concentrated by the second anti-winding groove 112C before entering the first anti-winding groove 112B, so as to realize an anti-winding function. Similarly, at least one second anti-winding groove 113C disposed circumferentially may be formed at a junction of the cleaning part 111 and the second circumferential protrusion 113A. For example, as shown in FIG. 10, the second anti-winding groove 113C may be adjacent to a right side of the second circumferential protrusion 113A, such that the objects to be cleaned are first collected and concentrated by the second anti-winding groove 113C before entering the first anti-winding groove 113B, so as to realize the anti-winding function, which will not be described herein.
4) As shown in FIG. 9, the brushroll chamber 12 may be provided with a first brushroll-chamber baffle 126 corresponding to an end-face side wall 125 of the brushroll chamber 12, in which the end-face side wall 125 of the brushroll chamber 12 is located at the rotating-shaft connecting part 112, and a brushroll-chamber recessed region, i.e. the second recessed region 122 described above, is formed between the end-face side wall 125 and the first brushroll-chamber baffle 126 and configured to accommodate the corresponding first circumferential protrusion 112A.

Because both bottom surfaces of the end-face side wall 125 and the first brushroll-chamber baffle 126 are lower than a top point P of a periphery of the first circumferential protrusion 112A (i.e. the second recessed region 122 partially surrounds the first circumferential protrusion 112A), an air-channel gap indicated by a black thick arrow in an upper portion of FIG. 9 is formed between the first circumferential protrusion 112A and the second recessed region 122, i.e. a section of the air-channel gap has a curved shape shown in FIG. 9. Thus, when the objects to be cleaned roam to the gear box region along a curved channel constituted by the air-channel gap, multiple bends of the air-channel gap cause a certain degree of obstruction, so as to realize an anti-winding effect. Particularly, as shown in FIG. 9, when the first circumferential protrusion 112A is provided with the first anti-winding groove 112B, the above air-channel gap may have more bends, thus enhancing the anti-winding effect thereof.

In the disclosure, besides the rotating-shaft connecting part 112 shown in FIG. 9, the above solution may also be adapted for other end faces of the brushroll chamber 12. For example, as shown in FIG. 10, the brushroll chamber 12 may be provided with a second brushroll-chamber baffle 128 corresponding to an end-face side wall 127 of the brushroll chamber 12, in which the end-face side wall 127 of the brushroll chamber 12 is located at the driven connecting part 113, and a brushroll-chamber recessed region, i.e. the third recessed region 123 described above, is formed between the end-face side wall 127 and the second brushroll-chamber baffle 128 and configured to accommodate the corresponding second circumferential protrusion 113A. Similarly, an air-channel gap indicated by a black thick arrow in an upper portion of FIG. 10 is formed between the second circumferential protrusion 113A and the third recessed region 123, and the anti-winding function is realized by the curved channel constituted by the air-channel gap, which will not be described herein.

Alternatively or additionally, similar curved channels may be formed between the brushroll casing 13 and the main brushroll 11, to realize the anti-winding function. For example, as shown in FIG. 9, the brushroll casing 13 may be provided with the first brushroll-casing baffle 131 corresponding to an end-face side wall 134 of the brushroll casing 13, in which the end-face side wall 134 of the brushroll casing 13 is located at the rotating-shaft connecting part 112, and a brushroll-casing recessed region 135 is formed between the end-face side wall 134 and the first brushroll-casing baffle 131 and configured to accommodate the corresponding first circumferential protrusion 112A. Thus, an air-channel gap indicated by a black thick arrow in a lower portion of FIG. 9 is formed between the first circumferential protrusion 112A and the brushroll-casing recessed region 135, and the anti-winding function is realized by the curved channel constituted by the air-channel gap, which will not be described herein.

Similarly, for example, as shown in FIG. 10, the brushroll casing 13 may be provided with the second brushroll-casing baffle 132 corresponding to an end-face side wall 136 of the brushroll casing 13, in which the end-face side wall 136 of the brushroll casing 13 is located at the driven connecting part 113, and a brushroll-casing recessed region 137 is formed between the end-face side wall 136 and the second brushroll-casing baffle 132 and configured to accommodate the corresponding second circumferential protrusion 113A. Similarly, an air-channel gap indicated by a black thick arrow in a lower portion of FIG. 10 is formed between the second circumferential protrusion 113A and the brushroll-casing recessed region 137, and the anti-winding function is realized by the curved channel constituted by the air-channel gap, which will not be described herein.

5) The first anti-winding structure 21 and the second anti-winding structure 22 do not necessarily exist simultaneously. For example, in an embodiment, only the first anti-winding structure 21 or only the second anti-winding structure 22 is present, which may be selected according to actual situations.

6) The first anti-winding structure 21 (the same applies to the second anti-winding structure 22, and the first anti-winding structure 21 is just taken as an example) may be provided to any one of the main brushroll 11, the brushroll chamber 12 and the brushroll casing 13, or two or even three thereof. For example, when the first anti-winding structure 21 is provided to the brushroll chamber 12, the first anti-winding structure 21 may be located at the top inner wall of the second recessed region 122, i.e. one end of the first anti-winding structure 21 is fixed to the top inner side of the second recessed region 122, and the other end thereof faces the first circumferential protrusion 112A, for example, touching and abutting against the surface of the first circumferential protrusion 112A, whose working principle is similar to the embodiment shown in FIG. 7, and hence will not be described herein.

When the first anti-winding structure 21 is provided to the main brushroll 11, one end of the first anti-winding structure 21 is fixed to the first circumferential protrusion 112A, and the other end thereof faces a radial outer side of the first circumferential protrusion 112A, such that when the main brushroll 11 rotates axially, the first anti-winding structure 21 may rotate along with the main brushroll 11, so as to at least partially fill up and sweep the gaps between the main brushroll 11 and the brushroll chamber 12 and between the main brushroll 11 and the brushroll casing 13 (i.e. the gap between the first circumferential protrusion 112A and the top inner wall of the second recessed region 122 and between the first circumferential protrusion 112A and the bottom inner wall of the region outside of the first brushroll-casing baffle 131).

2. Side Brush Structure

Figure 11:
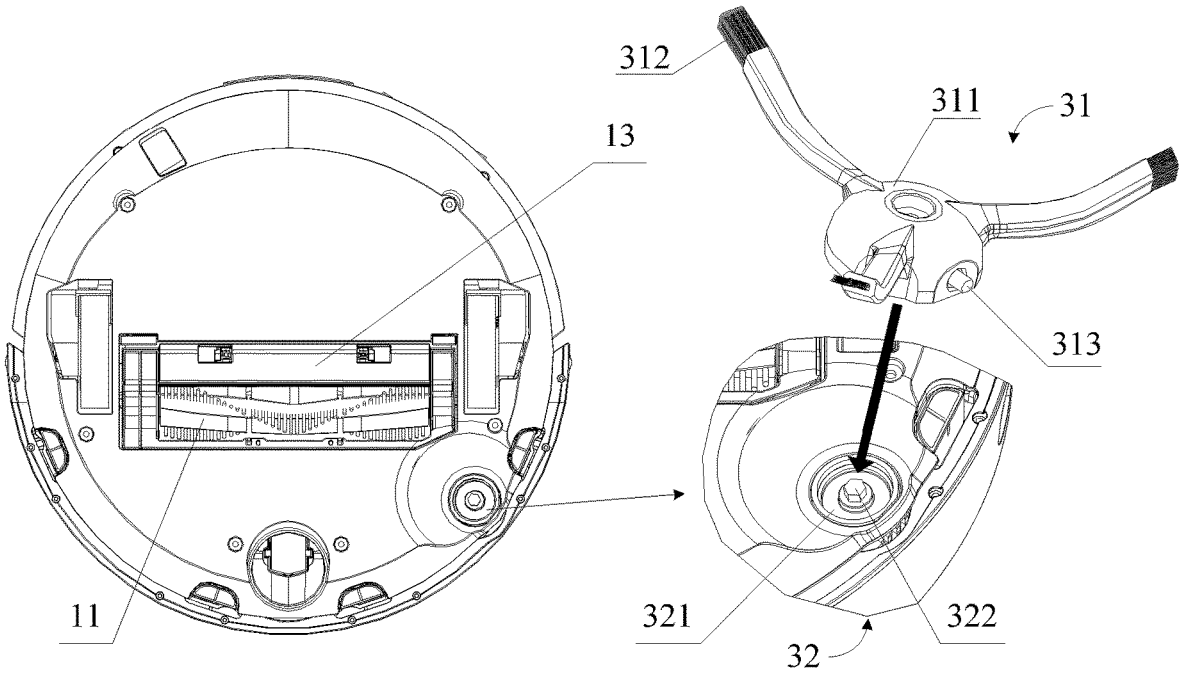
FIG. 11 is an exploded view of a side brush structure according to one or more embodiments.

In one or more illustrative embodiment, as shown in FIG. 11, the brush body may be a side brush 31, and the brush holder may be a side-brush holder structure 32 at a bottom of the automatic cleaning device. The side brush 31 may include a base 311 and bristles 312 provided to the base 311. The side-brush holder structure 32 is provided with a side-brush accommodating chamber 321, and a rotating shaft 322 is provided at a bottom of the side-brush accommodating chamber 321. One end of the rotating shaft 322 is connected with the power output end of the drive motor via gears, while the other end thereof extends out of the bottom of the side-brush accommodating chamber 321 to be connected to an end central region 311A of the base 311, so as to drive the side brush 31 to rotate, thus realizing the sweeping function.

Figure 12:
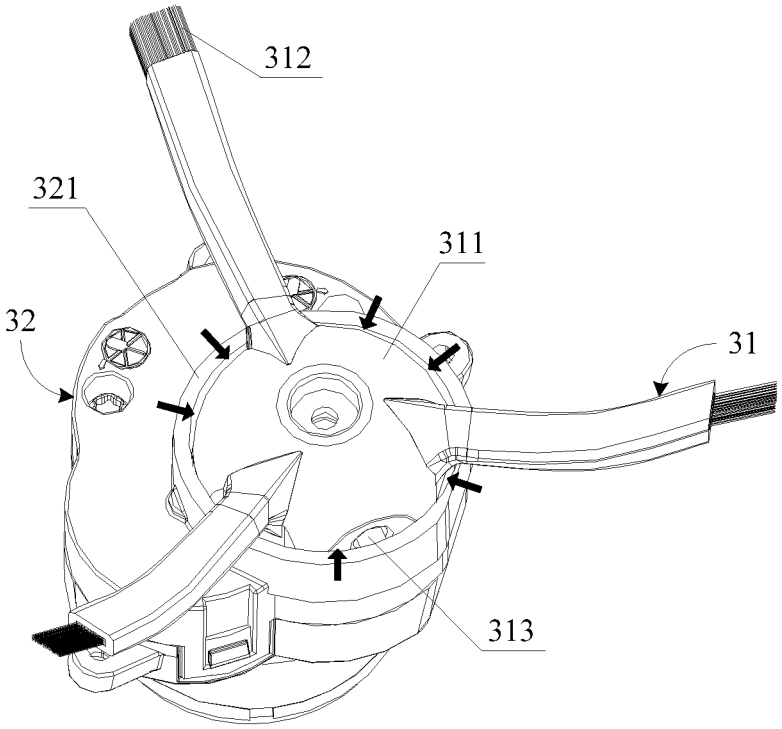
FIG. 12 is a perspective view of the side brush structure shown in FIG. 11.

FIG. 12 is a perspective view of the side brush structure in which the side brush is mounted to the side-brush holder structure 32. As shown in FIG. 12, when the side brush 31 is placed into the side-brush accommodating chamber 321, a certain gap (as indicated by black arrows in FIG. 12) exists between the base 311 of the side brush 31 and the side-brush accommodating chamber 321, and this gap is indispensible and inevitable to guarantee smooth rotation of the side brush 31. Thus, a third anti-winding structure 313 may be provided to an outer side of the base 311 of the side brush 31, i.e. one end of the third anti-winding structure 313 is fixed to the base 311, while the other end thereof faces an inner wall of the side-brush accommodating chamber 321, for example, touching and abutting against the inner wall of the side-brush accommodating chamber 321, so as to at least partially fill up a gap between the base 311 of the side brush 31 and the side-brush accommodating chamber 321. Therefore, when the side brush 31 rotates with a high speed, since the side-brush holder structure 32 does not rotate, the third anti-winding structure 313 may rotate synchronously with the side brush 31. Thus, on one hand, the third anti-winding structure 313 may block the gap to prevent the objects to be cleaned (like hair) from entering the end central region 311A of the base 311 via the gap, so as to avoid winding around the rotating shaft 322 and affecting a normal rotation of the side brush 31, and further to prevent damages to the rotating shaft 322 and its associated bearing area; on the other hand, the third anti-winding structure 313 may sweep up and collect the objects to be cleaned which enter the above gap, so as to facilitate the clean-up.

In other words, a joint of the side brush 31 and the side-brush holder structure 32 may be located at the gap between the base 311 and the side-brush accommodating chamber 321. Besides the arrangement employed in the above embodiment, the third anti-winding structure 313 may be provided to the inner wall of the side-brush accommodating chamber 321 defined by the side-brush holder structure 32, i.e. one end of the third anti-winding structure 313 is fixed to the inner wall of the side-brush accommodating chamber 321, while the other end thereof faces the base 311, for example, touching and abutting against an outer wall of the base 311, whose working principle is similar to the above embodiment and hence will not be described in detail.

Meanwhile, the third anti-winding structure 313 may adopt the same soft materials in the above embodiment concerning "the main brushroll structure", which will not be described in detail.

Figure 13:
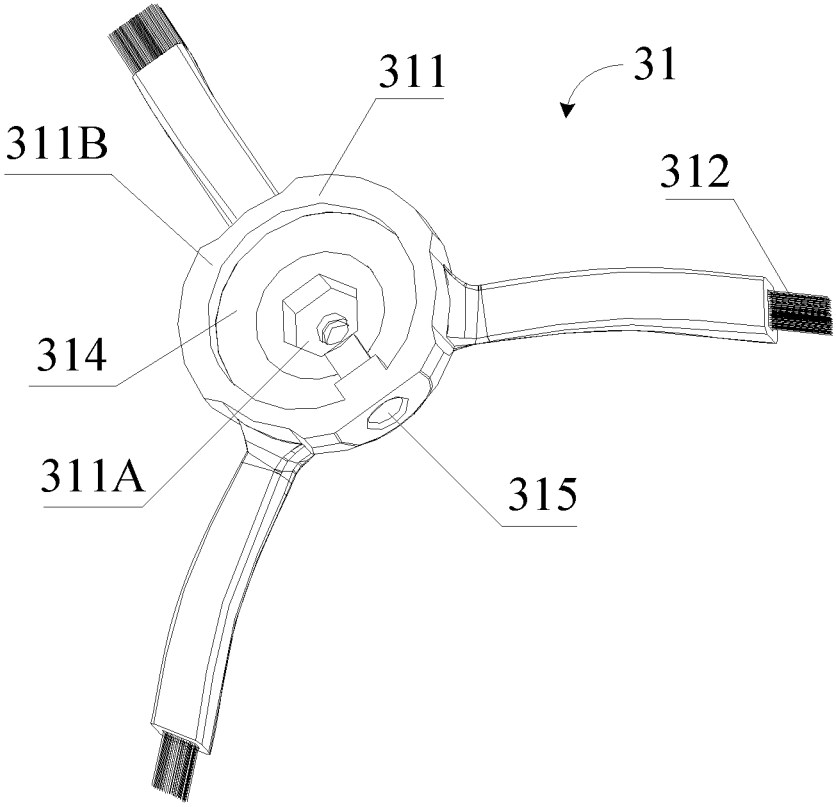
FIG. 13 is a schematic view of a bottom of a side brush in the side brush structure shown in FIG. 11.

Alternatively or additionally, as shown in FIG. 13, when the end central region 311A of the base 311 of the side brush 31 is connected with the rotating shaft 322 at the bottom of the side-brush accommodating chamber 321, at least one annular anti-winding groove 314 may be formed between an end edge 311B of the base 311 of the side brush 31 and the end central region 311A, such that even if a small amount of the objects to be cleaned passes through obstruction of the third anti-winding structure 313, the small amount of the objects to be cleaned can still be collected and received in the annular anti-winding groove 314, so as to prevent the small amount of the objects to be cleaned from causing interference and influence to the rotating shaft 322. As shown in FIG. 13, by providing an opening 315 in the outer wall of the base 311, the third anti-winding structure 313 may be inserted into the opening 315, such that an inner end of the third anti-winding structure 313 is secured in the opening 315, while an outer end thereof projects out of the opening 315 to abut against the inner wall of the side-brush accommodating chamber 321.

The terminology used in the present disclosure is for the purpose of describing exemplary embodiments only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

Other embodiments of the present disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the disclosure only be limited by the appended claims.

What is claimed is:

1. A sweeping assembly for a cleaning device, comprising:

a brush holder defining an accommodating cavity therein;

a main brushroll accommodated in the accommodating cavity of the brush holder, the main brushroll comprising a cleaning part located at a middle portion of the main brushroll and a connecting part located at an end of the main brushroll, the connecting part being connected to the brush holder or a driver of the cleaning device; and an anti-winding structure arranged at the brush holder, and comprising a first end connected to the brush holder, and a second end abutting against the brushroll, wherein the brush holder comprises a brushroll chamber and a brushroll casing connected to each other to define the accommodating cavity therebetween, and the anti-winding structure is arranged at the brushroll casing.

2. The sweeping assembly according to claim 1, wherein the anti-winding structure extends in a radial plane of the brushroll.

3. The sweeping assembly according to claim 1, wherein the anti-winding structure has an included angle relative to a radial direction of the brushroll in a plane perpendicular to an axial direction of the brushroll.

4. The sweeping assembly according to claim 1, wherein the connecting part comprises a rotating-shaft connecting part located at one end of the main brushroll, and a driven connecting part located at the other end of the main brushroll, the rotating-shaft connecting part is connected to the driver of the cleaning device to drive the main brushroll to rotate, and the driven connecting part is connected to the brush holder, and the cleaning part comprises a brush member protruding outward therefrom.

5. The sweeping assembly according to claim 4, wherein the anti-winding structure is at least partially disposed on at least one of the rotating-shaft connecting part and the driven connecting part, the first end of the anti-winding structure is connected to one of the brush holder and the at least one of the rotating-shaft connecting part and the driven connecting part, and the second end of the anti-winding structure abuts against the other one of the brush holder and the at least one of the rotating-shaft connecting part and the driven connecting part.

6. The sweeping assembly according to claim 1, wherein the connecting part is provided with a circumferential protrusion, the first end of the anti-winding structure is connected to one of the brush holder and the circumferential protrusion of the connecting part, and the second end of the anti-winding structure abuts against the other one of the brush holder and the circumferential protrusion of the connecting part.

7. The sweeping assembly according to claim 6, wherein the circumferential protrusion comprises a first anti-winding groove arranged circumferentially, and the first anti-winding groove is arranged between the anti-winding structure and the cleaning part.

8. The sweeping assembly according to claim 7, further comprising a second anti-winding groove arranged circumferentially at a junction of the cleaning part and the circumferential protrusion, and located between the cleaning part and the first anti-winding groove.

9. The sweeping assembly according to claim 6, wherein the first end of the anti-winding structure is fixed to the brushroll chamber or the brushroll casing, and the second end of the anti-winding structure abuts against the connecting part; or the first end of the anti-winding structure is fixed to the connecting part, and the second end of the anti-winding structure abuts against the brushroll chamber or the brushroll casing.

10. The sweeping assembly according to claim 9, wherein at least one of the brushroll chamber and the brushroll casing has an end-face side wall and a baffle opposite to the end-face side wall to define a recessed region therebetween, and the recessed region is configured to accommodate the connecting part therein.

11. The sweeping assembly according to claim 10, wherein bottom surfaces of the end-face side wall and the baffle are lower than a top point of a periphery of the circumferential protrusion when the sweeping assembly operates in a working state on a floor.

12. A cleaning device, comprising:

a sweeping assembly; and a driver connected to the sweeping assembly and configured to drive the sweeping assembly to rotate, wherein the sweeping assembly comprising:

a brush holder;

a brush body arranged in the brush holder, and comprising a cleaning part and a connecting part connected to each other, the connecting part being further connected to the driver to rotate the brush body, the cleaning part comprising a brush member protruding outward therefrom; and an anti-winding structure arranged at the brush holder and comprising a first end connected to the brush holder, and a second end abutting against the brushroll, the anti-winding structure configured to fill up a gap between the brush holder and the connecting part by the transfer of the second end, wherein the anti-winding structure has an included angle relative to a radial direction of the brushroll in a plane perpendicular to an axial direction of the brushroll.

13. The cleaning device according to claim 12, the brush holder comprises a brushroll chamber and a brushroll casing connected to each other to define the accommodating cavity therebetween, and the anti-winding structure arranged at the brushroll casing.

14. The cleaning device according to claim 12, wherein the anti-winding structure is made of soft materials, and configured to be elastically deformed when the cleaning device operates in a working state.

15. The cleaning device according to claim 14, wherein the soft materials comprise at least one tuft of bristles.

* * * * *